United States Patent [19]

Yoshida et al.

[11] Patent Number: 5,074,684

[45] Date of Patent: Dec. 24, 1991

[54] DOT PRINTER DEVICE HAVING A CONTROL UNIT TO PRINT HORIZONTAL LINES

[75] Inventors: Shinichi Yoshida; Hachio Tsuchida; Shigeo Onda; Mitsuaki Maeta, all of Hadano; Eiji Yamagata, Tajimi, all of Japan

[73] Assignees: Hitachi, Ltd.; Hitachi Information Systems, Ltd., both of Tokyo, Japan

[21] Appl. No.: 412,218

[22] Filed: Sep. 25, 1989

[30] Foreign Application Priority Data

Sep. 26, 1988 [JP] Japan ..... 63-238757

[51] Int. Cl.[5] ..... B41J 2/30

[52] U.S. Cl. ..... 400/17; 400/53; 400/124

[58] Field of Search ..... 400/17, 124, 53; 101/93.05

[56] References Cited

U.S. PATENT DOCUMENTS 4,412,226 10/1983 Yoshida ..... 346/1.1

FOREIGN PATENT DOCUMENTS 0156074 12/1980 Japan ..... 400/17
0153665 9/1983 Japan ..... 400/17
0015169 1/1985 Japan ..... 400/17
0113566 5/1987 Japan ..... 400/17
0116158 5/1987 Japan ..... 400/17

*Primary Examiner*—Edgar S. Burr
*Assistant Examiner*—John S. Hilten
*Attorney, Agent, or Firm*—Antonelli, Terry, Stout & Kraus

[57] ABSTRACT

A dot printer device is disclosed, in which in order to print a horizontal ruled line, paper feed data for placing the head pin of a printing head at a predetermined position on a printing paper, dot pin data indicative of a dot pin specified on the basis of a predetermined rotation of dot pins for printing the horizontal ruled line, and paper feed data indicative of how much the printing paper is to be moved in accordance with the predetermined rotation of dot pins after the horizontal ruled line has been printed by the specified dot pin, are sent from a control unit to a printing unit.

3 Claims, 8 Drawing Sheets

| | | | |
|---|---|---|---|
| DOT PIN START COMMAND | DOT PIN DATA 3BYTES x THE NUMBER OF COLUMNS FORMED OF DOTS | PAPER FEED DATA | PAPER FEED |

FIG. 6

601 602 603 604 600

| | RULED LINE | HORIZONTAL-RULED-LINE PITCH EQUAL TO 1/6 IN. | | HORIZONTAL-RULED-LINE PITCH EQUAL TO 1/5 IN. | | HORIZONTAL-RULED-LINE PITCH EQUAL TO 1/4 IN. | |
|---|---|---|---|---|---|---|---|
| | | DOT PIN FOR PRINTING RULED LINE | PAPER FEED DATA | DOT PIN FOR PRINTING RULED LINE | PAPER FEED DATA | DOT PIN FOR PRINTING RULED LINE | PAPER FEED DATA |
| 1 | a | 203 (203~206) | 4/120 IN. | 206 (203~212) | 8/120 IN. | 211 (203~221) | 14/120 IN. |
| | b | 201~224 | 10/120 IN. | 201~224 | 12/120 IN. | 201~224 | 14/120 IN. |
| 2 | c | 212 (210~215) | 10/120 IN. | 212 (207~218) | 12/120 IN. | 214 (204~224) | 16/120 IN. |
| | d | 201~224 | 4/120 IN. | 201~224 | 8/120 IN. | 201~224 | 16/120 IN. |
| 3 | e | 221 (219~224) | 16/120 IN. | 218 (213~224) | 16/120 IN. | ----- | --- |
| | f | 201~224 | 16/120 IN. | 201~224 | 16/120 IN. | ----- | --- |

DOT PINS PUT IN PARENTHESES INDICATE DOT PINS FOR PRINTING VERTICAL RULED LINE

FIG. 7A
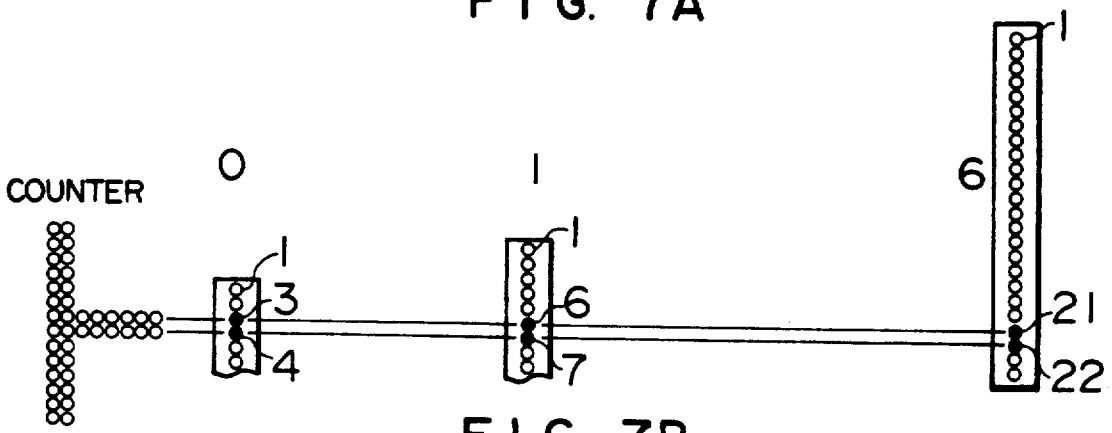
FIG. 7B
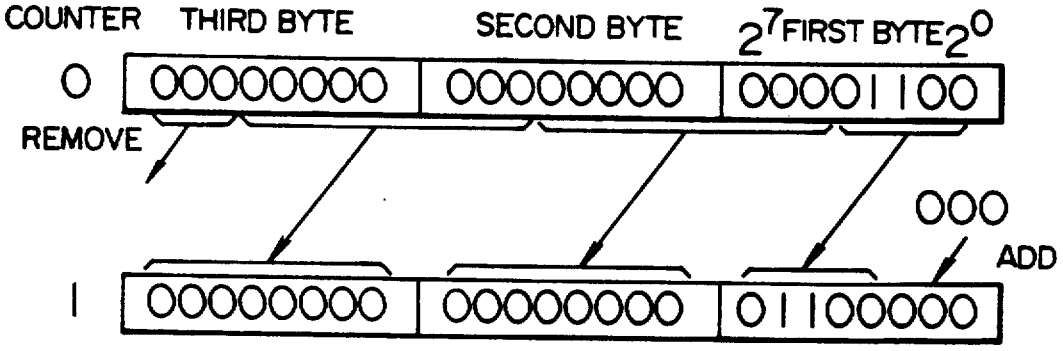
FIG. 7C
| COUNTER | 0 | 1 | 2 | 3 | 4 | 5 | 6 |
|---|---|---|---|---|---|---|---|
| SHIFTING QUANTITY EXPRESSED IN BITS | 0 | 3 | 6 | 9 | 12 | 15 | 18 |

| COUNTER | 0 | 1 | 2 | 3 | 4 | 5 | 6 |
|---|---|---|---|---|---|---|---|
| DOT DATA | 0C | 60 | 00 | 00 | 00 | 00 | 00 |
| | 00 | 00 | 03 | 18 | C0 | 00 | 00 |
| | 00 | 00 | 00 | 00 | 00 | 06 | 30 |
| PAPER FEED DATA | 4 | 6 | 8 | 10 | 12 | 14 | 16 |
| | 16 | 14 | 12 | 10 | 8 | 4 | 4 |

DOT PRINTER DEVICE HAVING A CONTROL UNIT TO PRINT HORIZONTAL LINES

BACKGROUND OF THE INVENTION

The present invention relates to a dot printer device, and more particularly to a dot printer device capable of increasing the life of a printing head.

In a conventional dot printer device, as described in, for example, a Japanese patent application Post-examination Publication No. 60-17668, data included in printing data for indicating a ruled line is recognized by the control part of the printer device, to carry out rotation of printing dot pins. Accordingly, the dot printer device is required to include means for recognizing the ruled line data. In other words, dot printer devices other than the above-mentioned device pay no attention to rotation of dot pins. Thus, in a case where a dot printer device incapable of recognizing ruled line data performs a printing operation for printing ruled lines, it is impossible to carry out rotation of dot pins, and thus horizontal ruled lines are printed by only a few specified dot pins. Hence, there arises a problem that the specified dot pins are worn away in a great degree.

Further, even in the dot printer device provided with means for recognizing ruled line data, horizontal ruled lines are printed by dot pins placed at specified positions. Hence, it is impossible to carry out rotation of dot pins in a case where characters having special construction are printed, or the horizontal-ruled-line pitch has a specified value. Thus, there arises a problem that the life of a printing head is shortened.

SUMMARY OF THE INVENTION

It is an object of the present invention to provide a dot printer device which can solve the above problems of the prior art, and can carry out rotation of dot pins in accordance with a dot pin pitch, a paper feed pitch and a horizontal-ruled-line pitch, to prevent horizontal ruled lines from being printed by only a specified dot pin, thereby increasing the life of a printing head in a great degree.

In order to attain the above object, according to the present invention, there is provided a dot printer device, in which in order to print a horizontal ruled line, paper feed data for placing the head pin of a printing head at a predetermined position on a printing paper, dot pin data indicative of a dot pin specified on the basis of a predetermined rotation of dot pins for printing the horizontal ruled line, and paper feed data indicative of how much the printing paper is to be moved in accordance with the predetermined rotation of dot pins after the horizontal ruled line has been printed by the specified dot pin, are sent from a control unit to a printing unit.

In more detail, the predetermined rotation of dot pins is carried out in such a manner that a dot pin for printing a horizontal ruled line is selected from the dot pins of the printing head at intervals of a predetermined number of dot pins each time a horizontal ruled line is printed.

The predetermined number of dot pins, that is, a rotation pitch, corresponds to an integral multiple of the least common multiple of the dot pin pitch at the printing head and a minimum paper feed pitch due to a paper feed mechanism.

Further, the paper feed data for carrying out rotation of dot pins is determined by the horizontal-ruled-line pitch, the paper feed data at a time the preceding horizontal ruled line was printed, and the minimum paper feed pitch.

In other words, according to the present invention, when a ruled line is printed, the control unit for controlling the printing unit supplies the printing unit with paper feed data indicative of a paper feed quantity and dot pin data indicative of a dot pin or dot pins specified in accordance with the paper feed quantity for printing the ruled line. Thus, printing paper is moved in a vertical direction in accordance with the paper feed data, to obtain a predetermined position relation between the printing paper and the dot pin group of the printing head, and the dot pin data at the above positional relation is supplied to the printing unit to specify a dot pin for printing a horizontal ruled line. Further, a plurality of combinations of paper feed data and dot pin data are produced to print horizontal ruled lines by different dot pins.

For example, in a case where a dot printer connected to a work station or the like performs a printing operation for printing ruled lines, a paper feed quantity is varied each time a ruled line is printed, to replace a dot pin for printing a horizontal ruled line by a different dot pin, thereby preventing a specified dot pin from being worn away, that is, increasing the life of a printing head.

BRIEF DESCRIPTION OF THE DRAWINGS

FIG. 6 is a table showing an example of the combination of rotation of dot pins and paper feed data for each of different horizontal-ruled-line pitches.

FIGS. 7A, 7B and 7C show that dot pin data for printing horizontal ruled lines can be obtained by shifting pre-edited dot pin data successively.

DESCRIPTION OF THE PREFERRED EMBODIMENT

Figures 1A, 1B:
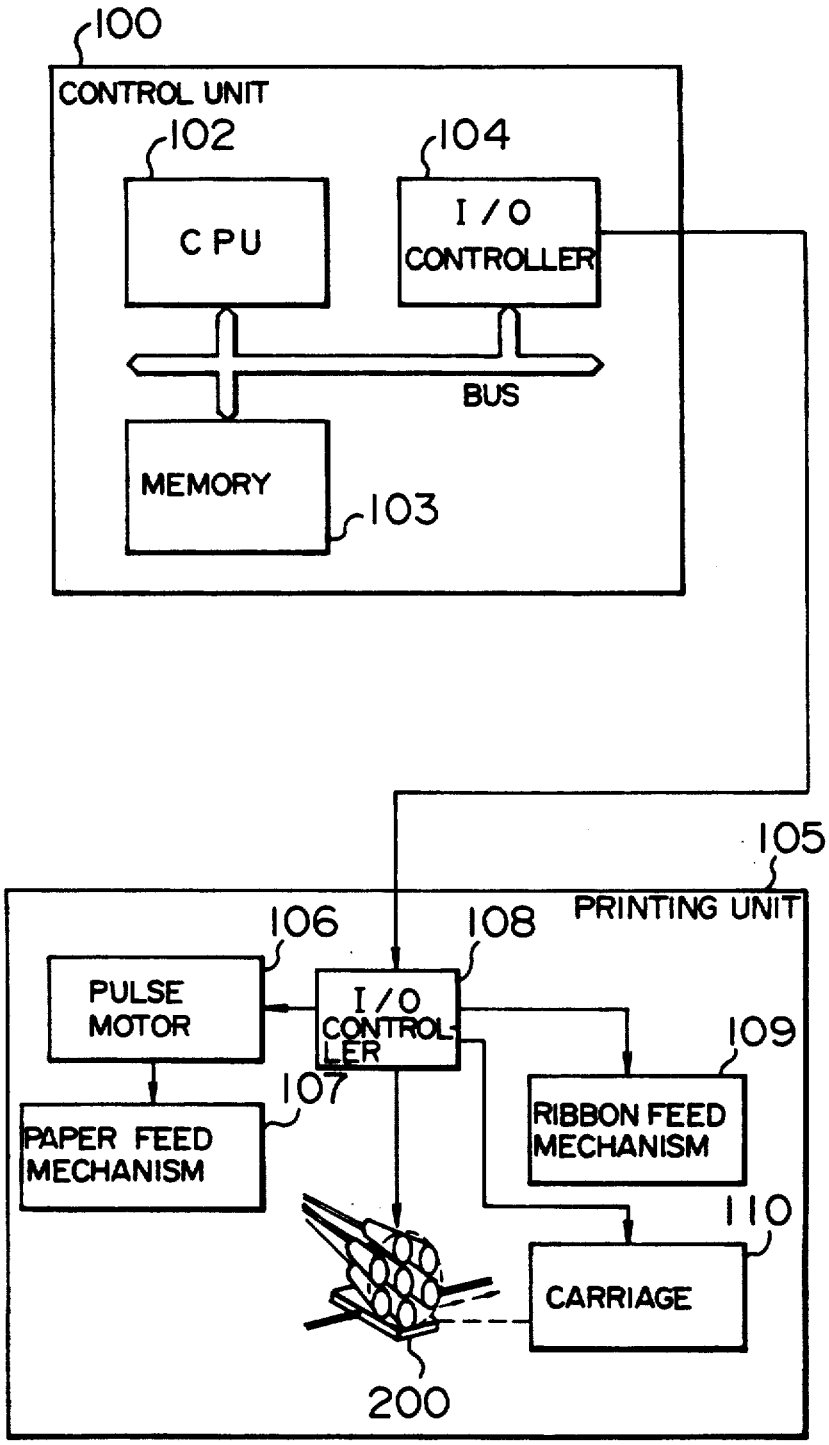
FIG. 1A is a block diagram showing the whole construction of an embodiment of a dot printer device according to the present invention.
FIG. 1B shows an example of the format of data which is sent from the control unit of FIG. 1A to the printing unit thereof.

FIG. 1A shows the construction of an embodiment of a dot printer device according to the present invention. As shown in FIG. 1A, the present embodiment is divided into a control unit 100 and a printing unit 105. The control unit 100 is made up of a central processing unit (CPU) 102, a memory 103 and an I/O controller 104, and these parts 102, 103 and 104 are connected to one another through a bus. The memory 103 stores therein predetermined programs and various data such as dot pin data indicative of rotation of dot pins necessary for printing horizontal ruled lines and paper feed data. The dot pin data will be explained later in detail. The CPU 102 carries out various processing on the basis of the programs and data stored in the memory 102, and performs an editing operation. Further, the CPU 102 controls the I/O controller 104. Data having the format of FIG. 1B is sent from the I/O controller 104 to the printing unit 105. The printing unit 105 includes a pulse motor 106, a paper feed mechanism 107, an I/O controller 108, an ink-ribbon feed mechanism 109, a carriage 110 and a printing head 200.

Data from the control unit 100 is sent to the parts 106, 109, 110 and 200 through the I/O controller 108. Thus, the pulse motor 106 drives the paper feed mechanism 107 so that printing paper is moved by a predetermined quantity, and the carriage 110 moves the printing head 200 so that a desired printing operation is performed. Simultaneously with the above movement of the printing head, the ink-ribbon feed mechanism 109 is driven to move an ink-ribbon.

Figure 2:
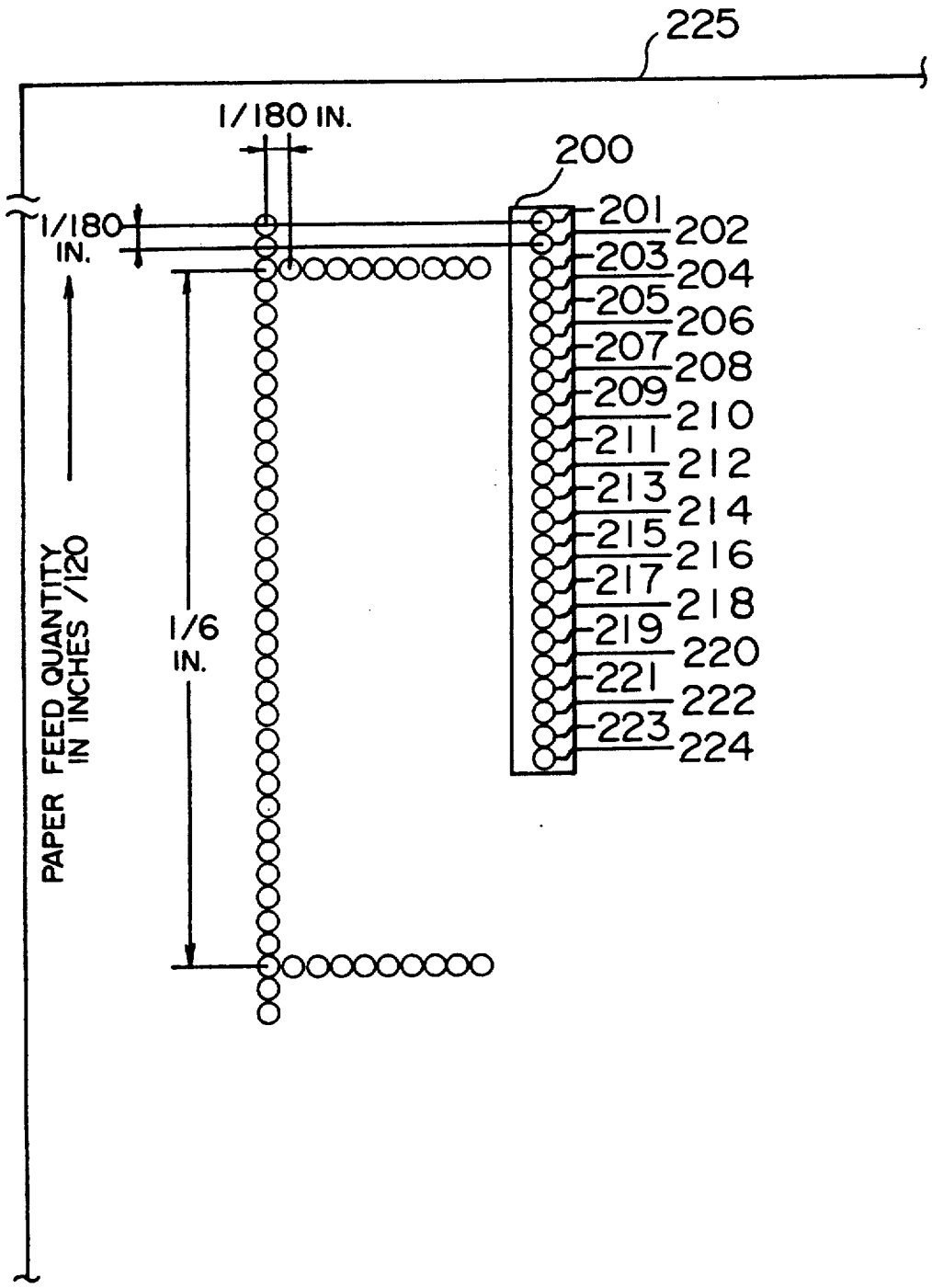
FIG. 2 is a schematic diagram showing the dot pins of the printing head which is included in the printing unit of FIG. 1A, the dot pitch of the dot pins, a horizontal-ruled-line pitch, and a minimum paper feed pitch.

In the present embodiment, as exemplified in FIG. 2, the printing head 200 which is provided with dot pins 201 to 224 having a dot pitch of 1/180 in. is used to perform a printing operation for paper 225. Further, the paper feed mechanism 107 can move the paper 225 at a minimum paper feed pitch of 1/120 in. As shown in FIG. 2, horizontal ruled lines having a line feed pitch of 1/6 in. can be printed by using the above-mentioned dot pitch and paper feed pitch.

Figure 3:
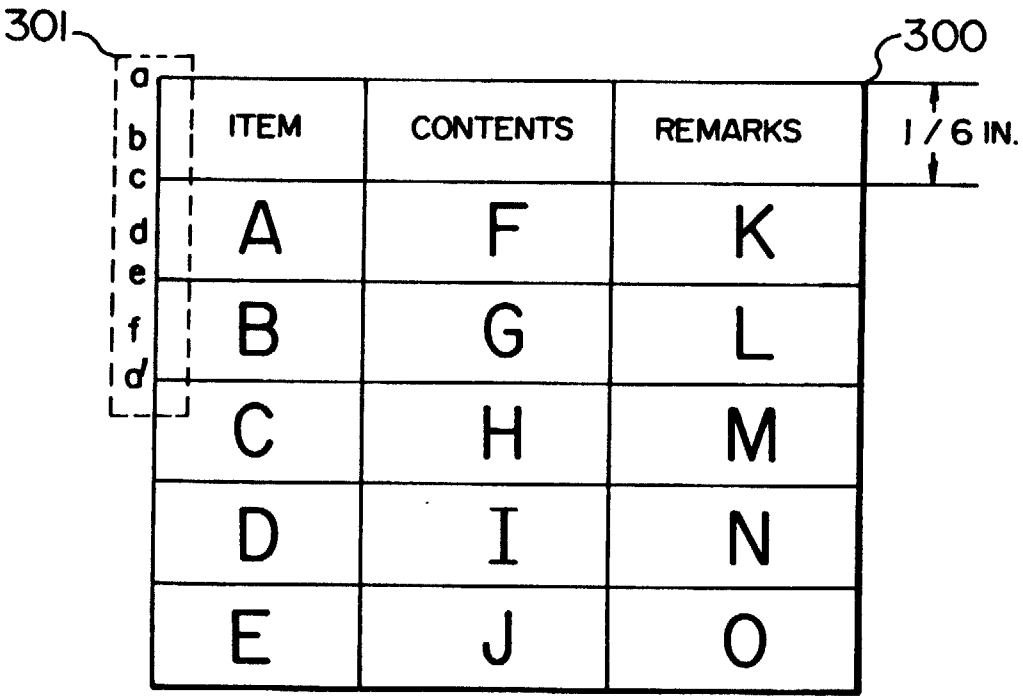
FIG. 3 shows a table having ruled lines which are to be printed by the embodiment of FIG. 1A.
Figure 4:
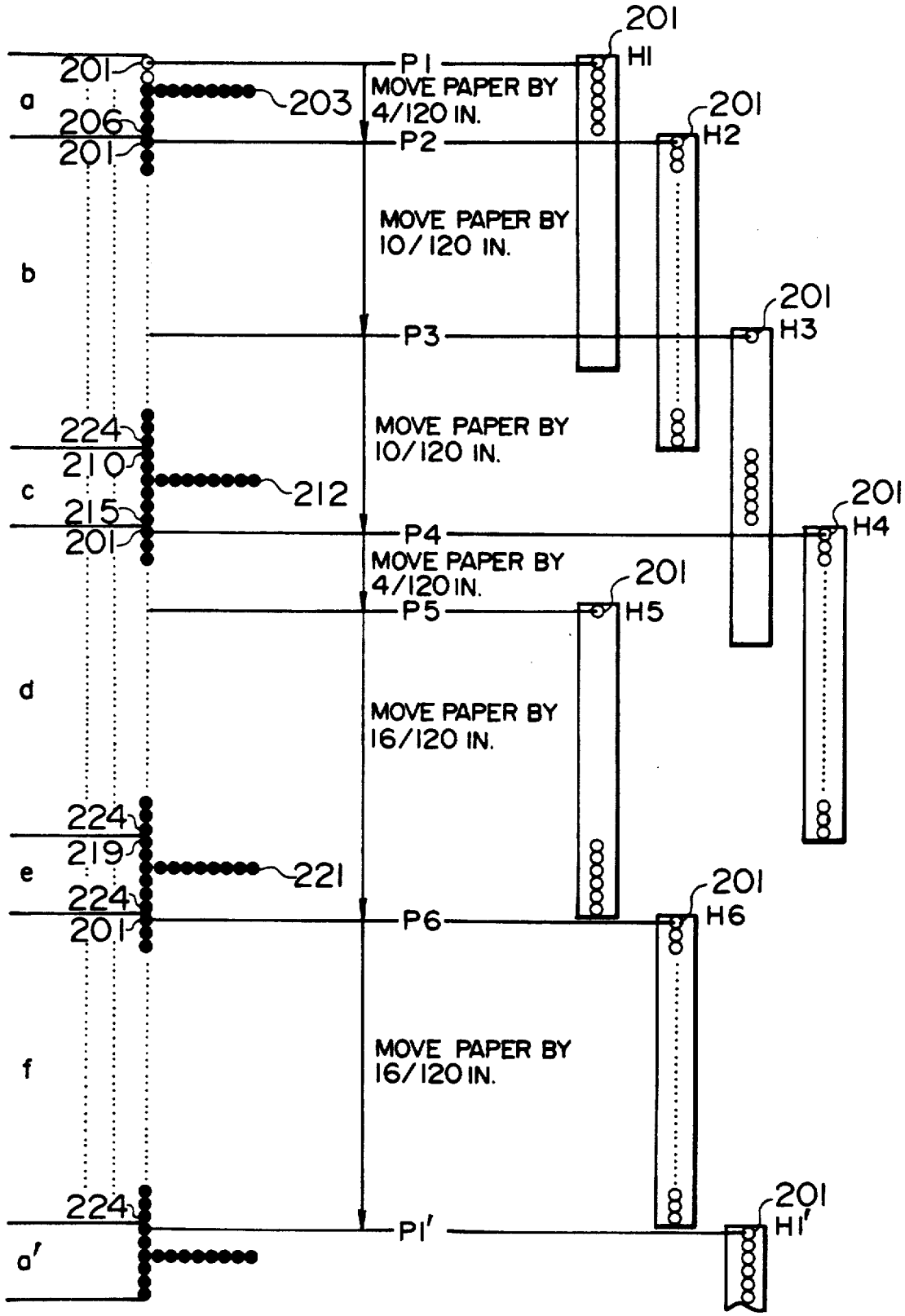
FIG. 4 is a schematic diagram showing rotation of dot pins in a case where the ruled lines in the part of FIG. 3 are printed by the embodiment of FIG. 1A, and showing paper feed quantities for carrying out the rotation of dot pins.
Figure 5:
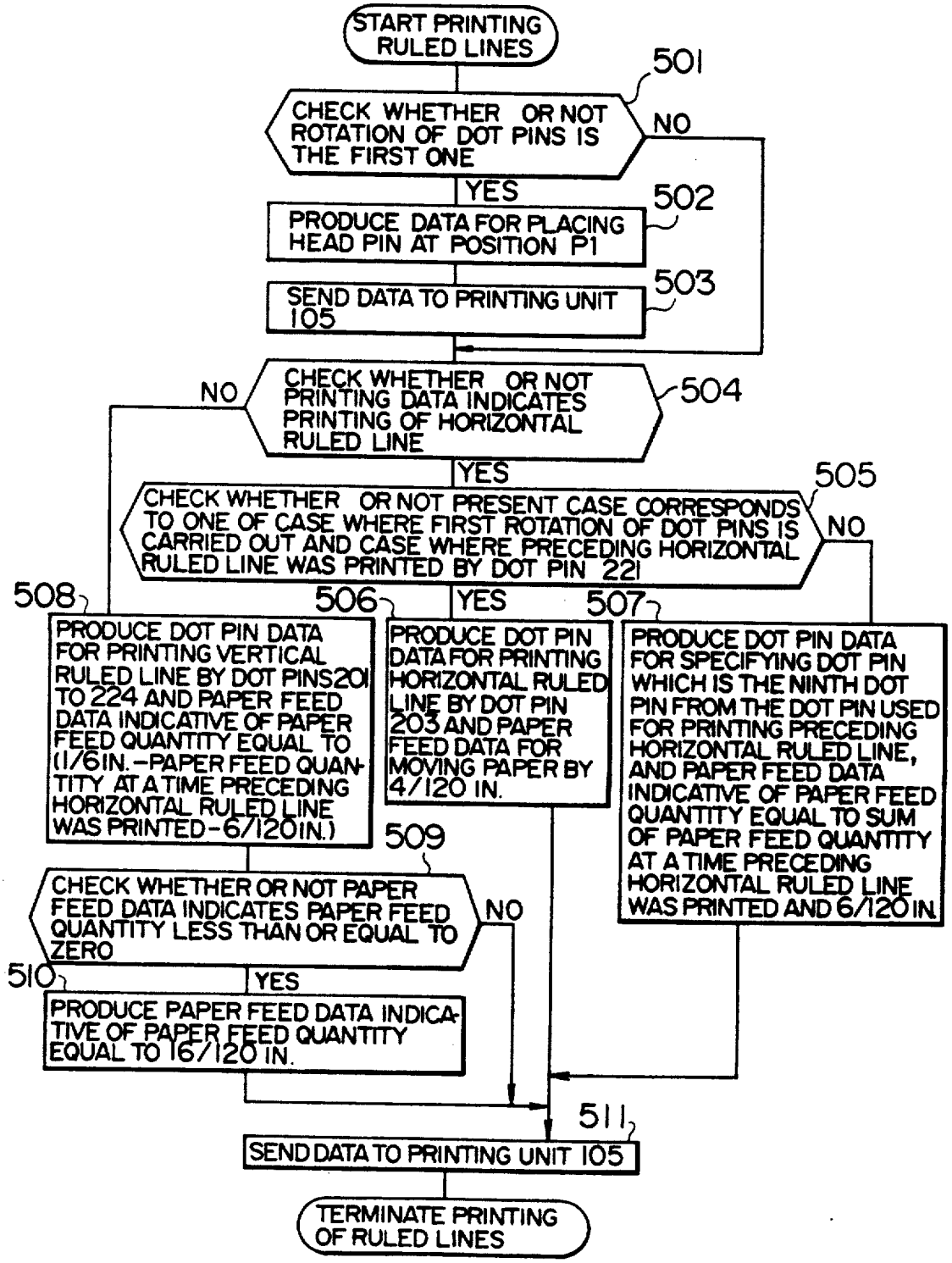
FIG. 5 is a flow chart showing how paper feed data and dot pin data necessary for printing the ruled lines of FIG. 4 are produced by the control unit of FIG. 1A.

Now, let us consider a case where ruled lines of a portion 301 of a table 300 shown in FIG. 3 are printed by the present embodiment. FIG. 4 is an enlarged view showing the above ruled lines which have been printed by the present embodiment, in dots, and FIG. 5 is a flow chart showing how the ruled lines are printed.

In order to print ruled lines at an interval of 1/6 in., it is necessary to use dot pins, the number of which is equal to the quotient of the line feed pitch (=1/6 in.) divided by the dot pitch (=1/180 in.), that is, 30 dot pins. In the present embodiment, however, the printing head is provided with only 24 dot pins. Accordingly, it is necessary to perform a plurality of printing operations for a region between adjacent horizontal ruled lines. Now, let us pay attention to a fact that the least common multiple of the dot pitch (=1/180 in.) and the minimum paper feed pitch (=1/120 in.) is equal to 1/60 in., that is, the least common multiple is three times larger than the dot pitch and twice larger than the minimum paper feed pitch. In order to prevent the deviation of a horizontal ruled line from one of 24 dot pins, a dot pin for printing a horizontal ruled line is selected from the dot pins 201 to 224 of FIG. 2 at intervals of a multiple of three pins. In more detail, in the present embodiment, rotation of dot pins for printing horizontal ruled lines is carried out in such a manner that a dot pin for printing a horizontal ruled line is selected from the dot pins 201 to 224 at intervals of 9 dot pins, that is, dot pins 203, 212 and 221 are successively selected.

Referring to FIG. 4, in order to print ruled lines included in an area a, the paper feed mechanism 107 is driven so that the head pin 201 of the printing head 200 is placed at a position P1 on the paper 225, and a vertical ruled line in the area a is printed by the dot pins 203 to 206. Then, the uppermost horizontal ruled line of the table 300 is printed by the dot pin 203. The dot pins 201 and 202 are not used to print the horizontal ruled line, for convenience sake.

Next, in order to print a vertical ruled line included in an area b, the paper is moved by a distance of 4/120 in. so that the head pin 201 is placed at a position P2 on the paper 225 which position is spaced apart from the position P1 a distance of 4/120 in., and the above vertical ruled line is printed by the dot pins 201 to 224. Further, in order to print ruled lines included in an area c, the paper is moved by a distance of 10/120 in. so that the head pin 201 is placed at a position P3 on the paper which position is spaced apart from the position P2 a distance of 10/120 in., and a vertical ruled line in the area c is printed by the dot pins 210 to 215. Further, a horizontal ruled line in the area c is printed by the dot pin 212. Next, in order to print a vertical ruled line included in an area d, the paper is moved by a distance of 10/120 in. so that the head pin 201 is placed at a position P4 on the paper which position is spaced apart from the position P3 a distance of 10/120 in., and the vertical ruled line is printed by the dot pins 201 to 224.

Further, in order to print ruled lines included in areas e and f, the moving distance of the paper is varied in a manner similar to the above-mentioned, and thus dot pins 203, 212 and 221 are successively used for printing horizontal ruled lines.

The present embodiment can print horizontal ruled lines on the paper in the above-mentioned manner. In order to perform such a printing operation, the printing data having the format of FIG. 1B is sent from the control unit 100 to the printing unit 105 each time a ruled line is printed, that is, each time rotation of dot pins is carried out. Referring to FIG. 1B, dot pin data is formed of three bytes multiplied by 2,448 (which indicates the width of the paper expressed in dots) and includes data for specifying a dot pin used for printing a horizontal ruled line, and paper feed data indicates how much the paper is to be moved after the horizontal ruled line or horizontal and vertical ruled lines have been printed on the basis of the above dot pin data.

FIG. 5 shows a flow chart for explaining how data with respect to rotation of dot pins is produced by the control unit 100, by way of example.

Referring to FIG. 5, it is checked whether or not the present rotation of dot pins is the first one (step 501). When the present rotation of dot pins is judged to be the first one, paper feed data for placing the head pin 201 at the position P1 on the paper is produced (step 502). The paper feed data thus obtained is sent to the printing unit 105 (step 503). When it is judged in the step 501 that the present rotation of dot pins is not the first one, the processing in step 504 is carried out. In the step 504, it is checked whether or not printing data which is now being processed, includes data indicating the printing of a horizontal ruled line. When it is judged in the step 504 that the data indicating the printing of a horizontal ruled line is included in the printing data, the processing in step 505 is carried out. In the step 505, it is checked whether or not the present case corresponds to one of a case where the first rotation of dot pins is carried out and a case where the preceding horizontal ruled line was printed by the dot pin 221. When it is judged the present case corresponds to one of the above cases, the processing in step 506 is carried out. That is, when the present case corresponds to the case where the first rotation of dot pins is carried out, dot pin data for printing a vertical ruled line by the dot pins 203 to 206 and for printing a horizontal ruled line by the dot pin 203 is produced, and this dot pin data is sent to the printing unit 105 together with paper feed data for moving the paper by a distance of 4/120 in. (Step 511). Further, when it is judged that the present case corresponds to a case where the preceding horizontal ruled line was printed by the dot pin 221, dot pin data for printing a horizontal ruled line by the dot pin 203 and paper feed data for moving the paper by a distance of 4/120 in. are produced, as in the case where the first rotation of dot pins is carried out. These dot pin data and paper feed data are sent to the printing unit 105.

When it is judged in the step 505 that the present case does not correspond to any one of the above cases, the processing in step 507 is carried out. The processing in the step 507 corresponds to, for example, the printing of a horizontal ruled line included in one of the areas c and e. In the step 507, dot pin data for specifying a dot pin which is the ninth dot pin from the dot pin used for printing the preceding horizontal ruled line, and paper feed data for indicating a paper moving quantity equal to sum of the paper moving quantity at a time the preceding horizontal ruled line was printed and a paper moving quantity of 6/120 in., are produced. These dot pin data and paper feed data are sent to the printing unit 105.

When it is judged in the step 504 that the printing data which is now being processed, indicates the printing of only a vertical ruled line, that is, corresponds to one of the areas b, d and f, the processing in step 508 is carried out. In the step 508, dot pin data for printing the vertical ruled line by those ones of the dot pins 201 to 224 which correspond to the area b, d or f, and paper feed data for indicating a paper moving quantity equal to (1/6 in. - the paper moving quantity at a time the preceding horizontal ruled line was printed—6/120 in.) are produced.

It is checked whether or not the paper moving quantity determined in the step 508 is a positive value (step 509). When the paper moving quantity is a positive value, the paper feed data indicating this paper moving quantity is sent to the printing unit 105 as it is, together with the dot pin data.

Now, let us consider a case where the paper moving quantity determined in the step 508 is judged to be negative, as in a case where a vertical ruled line included in the area f is printed. In this case, the preceding horizontal ruled line is printed by the dot pin 221. Hence, paper feed data indicative of a paper moving quantity of 16/120 in. is used, independently of the paper moving quantity determined in the step 508. This paper feed data is sent to the printing unit 105, together with the dot pin data indicative of dot pins used for printing the vertical ruled line.

In the present embodiment, rotation of dot pins is carried out for a case where horizontal ruled lines are printed at intervals of 1/6 in.

It is needless to say that rotation of dot pins can be carried out for a case where horizontal ruled lines are printed at intervals of a value different from 1/6 in.

FIG. 6 shows an example of rotation of dot pins in each of three cases, that is, a case where horizontal ruled lines are printed at intervals of 1/6 in., a case where horizontal ruled lines are printed at intervals of 1/5 in., and a case where horizontal ruled lines are printed at intervals of ¼ in. In other words, FIG. 6 shows a table 600 which indicates dot pin data and paper feed data in these cases. Referring to FIG. 6, a column 601 corresponds to the portion 301 of FIG. 3, and a column 602 indicates the dot pin data and paper feed data in the present embodiment. Further, a column 603 indicates dot pin data and paper feed data in a case where horizontal ruled lines are arranged at intervals of 1/5 in., and a column 604 indicates dot pin data and paper feed data in a case where horizontal ruled lines are arranged at intervals of ¼ in. In a case where horizontal ruled lines are arranged at intervals of ¼ in., 45 dot pins are required for printing horizontal and vertical ruled lines in one row. However, the printing head is provided with only 24 dot pins. Accordingly, in order to print the horizontal and vertical ruled lines in one row by the printing head, it is necessary to perform a printing operation twice. That is, 21 dot pins are used in the first printing operation, and 24 dot pins are used in the second printing operation. In view of a fact that the minimum common multiple of the dot pitch and the minimum paper feed pitch is three times larger than the dot pitch, it is preferable to select a dot pin for printing a horizontal ruled line, from the dot pins 201 to 224 of FIG. 2 at intervals of three dot pins. When the first printing operation using 21 dot pins and the second printing operation using 24 dot pins are performed as shown in the column 604, the above-mentioned rotation of dot pins can be carried out.

Further, rotation of dot pins can be carried out even in a case where the horizontal-ruled-line pitch (namely, line feed pitch) is different from those shown in the table 600. Further, when a plurality of dot pins selected from the dot pins 201 to 224 are successively used for printing horizontal rules lines, rotation of dot pins is carried out. In this case, it is necessary to use paper feed data corresponding to the above rotation of dot pins.

The rotation of dot pins according to the invention is not limited to the present embodiment, but is applicable to a dot printer device which is different from the present embodiment in dot pitch, paper feed pitch and function.

As has been explained in the above, according to the present invention, there is provided a method of controlling a dot printer in such a manner that data for rotation of dot pins is produced by the control unit 100, and then sent to the printing unit 105. This method is applicable to a dot printer device which does not have a function of recognizing ruled line data, and thus can increase the life of the printing head used.

In the present embodiment, each of horizontal and vertical ruled lines is expressed by a single line formed of dots, and rotation of dot pins is carried out in such a manner that dot pins which are selected from the dot pins 201 to 224 of FIG. 2 at intervals of 9 dot pins are successively used for printing a horizontal ruled line. Each of horizontal and vertical ruled lines may be expressed by a double line formed of dots, as shown in FIG. 7A. In the example shown in FIG. 7A, two adjacent dot pins which are selected from dot pins 1 to 24 at intervals of three dot pins, are used for printing a horizontal ruled line. Two dot pins for printing a horizontal ruled line can be selected by a counter which is included in the CPU 102 of the control unit 100, in a manner shown in FIG. 7B. FIG. 7C shows a counting number of the counter and a shifting quantity expressed in bits.

Further, in a case where the length of a printing head is greater than the horizontal-ruled-line pitch (namely, line feed pitch) and thus a plurality of horizontal ruled lines can be printed by a single printing operation, dot pin data for the horizontal ruled lines can be produced in a manner similar to that above-mentioned.

Figures 8A, 8B:
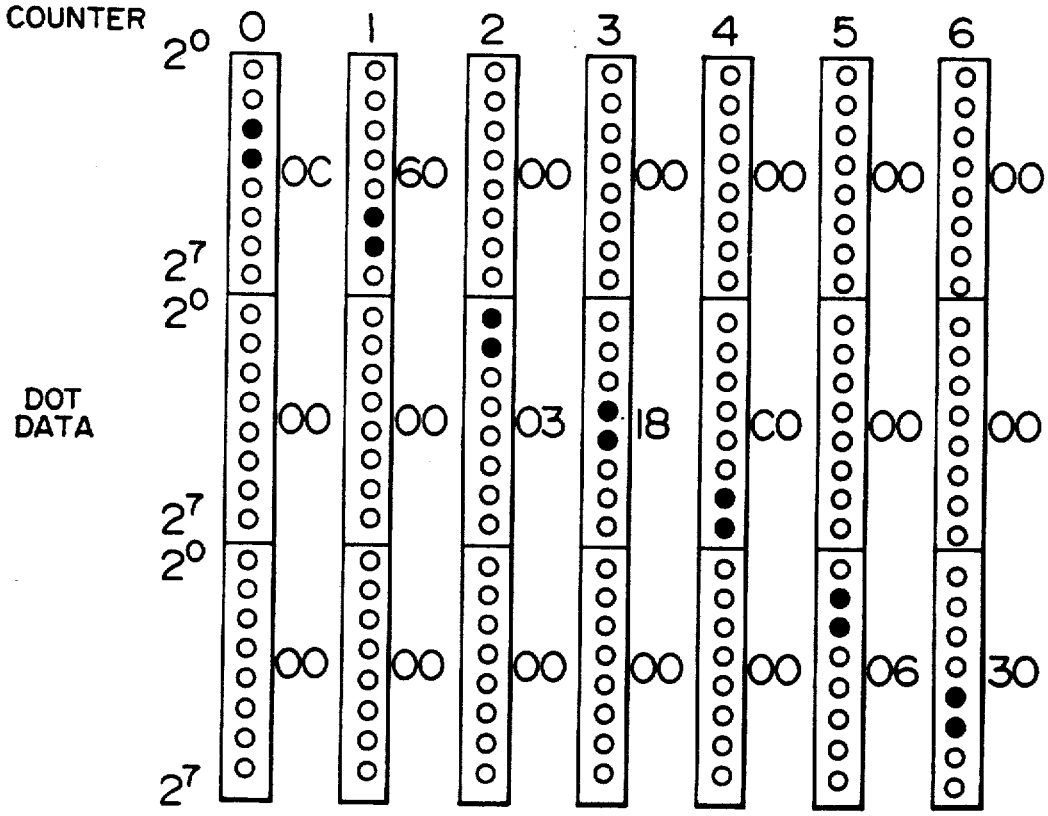
FIGS. 8A and 8B show how dot pin data for printing horizontal ruled lines can be selected from a multiplicity of previously-produced dot pin data for using all the dot pins.

Further, all dot pin data and paper feed data corresponding to predetermined dot pin pitch, paper feed pitch, line feed pitch and rotation of dot pins, may be previously produced and stored in the memory 103. In this case, dot pin data and paper feed data used for printing a ruled line, are updated by the operation of the CPU 102 similar to that of a rotation counter, as shown in FIGS. 8A and 8B. For example, the dot pin data and paper feed data in the column 602 of FIG. 6 are previously stored in the memory 103, and data for printing horizontal and vertical ruled lines is updated in such a manner that the dot pin data and paper feed data corresponding to the areas a and b are first outputted, and then the data corresponding to the areas c and d and the data corresponding to the areas e and f are successively outputted.

As has been explained in the foregoing, according to the present invention, data for specifying a dot pin used for printing a horizontal ruled line, data for indicating an interval at which a dot pin for printing a horizontal ruled line is selected from the dot pins of a printing head, and paper feed data for indicating a paper feed quantity necessary for printing a horizontal ruled line by a selected dot pin, are produced by the control unit, and then sent to the printing unit. Accordingly, rotation of dot pins can be carried out, independently of whether or not a dot printer device has a function of recognizing ruled line data, or independently of the number of dot pins included in the printing head and the minimum paper feed pitch due to a paper feed mechanism. Thus, the life of the printing head can be increased.

Further, an interval at which a dot pin for printing a horizontal ruled line is selected from the dot pins of a printing head can be varied. Accordingly, rotation of dot pins can be carried out in accordance with the use of a dot printer, and thus the life of a printing head can be increased even more.

We claim:

1. A dot printer device comprising:

a control unit for outputting printing data and first paper feed data associated with the printing data, dot pin data for specifying a dot pin which is to be used for printing a ruled line on the basis of a predetermined rotation of dot pins also being output from the control unit when a ruled line is to be printed, the predetermined rotation of dot pins being carried out according to a predetermined sequence of dot pins used for printing ruled lines, second paper feed data associated with the dot pin data for indicating how much a printing paper is to be moved after a ruled line has been printed by the specified dot pin being output from the control unit together with the dot pin data; and a printing unit for receiving from the control unit the printing data, the first paper feed data associated with the printing data, the dot pin data, and the second paper feed data associated with the dot pin data, the printing unit including a printing head and a paper feed mechanism, the printing head being provided with a plurality of dot pins which are controlled on the basis of the printing data from the control unit, the paper feed mechanism being adapted to move a printing paper on the basis of the first paper feed data associated with the printing data from the control unit at a fine pitch, the printing head and the paper feed mechanism being controlled in accordance with the dot pin data and the second paper feed data associated with the dot pin data for indicating how much the printing paper is to be moved after a ruled line has been printed by the specified dot pin;

wherein the predetermined rotation of dot pins is carried out in such a manner that a dot pin for printing a horizontal ruled line is selected from the dot pins of the printing head at a predetermined dot pin interval; and wherein the predetermined dot pin interval is equal to an integral multiple of the least common multiple of a dot pitch of the printing head and a minimum paper feed pitch of the paper feed mechanism.

2. A dot printer device according to claim 1, wherein the second paper feed data associated with the dot pin data at a time a horizontal ruled line is to be printed in accordance with the predetermined rotation of dot pins is determined on the basis of a dot pin used for printing a preceding horizontal ruled line and the second paper feed data associated with the dot pin data at a time the preceding horizontal ruled line was printed.

3. A dot printer according to claim 1, wherein the first paper feed data associated with the printing data at a time only a vertical ruled line is to be printed is determined on the basis of a distance between adjacent horizontal ruled lines and the second paper feed data associated with the dot pin data at a time a preceding horizontal ruled line was printed.

* * * * *